US006291784B1

(12) United States Patent
Neubauer et al.

(10) Patent No.: US 6,291,784 B1
(45) Date of Patent: Sep. 18, 2001

(54) SNAP SWITCH

(75) Inventors: Walter Neubauer, Lauffen/N; Reiner Mozer, Vaihingen; Rudolf Klein, Lauffen/Enz, all of (DE)

(73) Assignee: ITT Automotive Europe, GmbH, Frankfurt (DE)

( * ) Notice: Subject to any disclaimer, the term of this patent is extended or adjusted under 35 U.S.C. 154(b) by 0 days.

(21) Appl. No.: 09/298,527

(22) Filed: Apr. 23, 1999

Related U.S. Application Data

(63) Continuation-in-part of application No. 08/750,108, filed on Mar. 11, 1997, now abandoned.

(51) Int. Cl.[7] ..... H01H 13/22
(52) U.S. Cl. ..... 200/437; 200/439; 200/533
(58) Field of Search ..... 200/437, 439, 200/431, 551, 533, 47

(56) References Cited

U.S. PATENT DOCUMENTS

| | | | | |
|---|---|---|---|---|
| 1,087,251 | * | 2/1914 | Meaher | 200/439 |
| 3,042,764 | * | 7/1962 | Hermle | 200/47 |
| 3,639,714 | * | 2/1972 | Fujimoto et al. | 200/437 |
| 4,275,279 | * | 6/1981 | Wagatsuma et al. . | |
| 4,788,388 | * | 11/1988 | Burch et al. | 200/431 |
| 5,794,764 | * | 8/1998 | Hirose et al. | 200/437 |

FOREIGN PATENT DOCUMENTS

| | | | |
|---|---|---|---|
| 2928214 | | 1/1980 | (DE) . |
| 3336877 | * | 5/1985 | (DE) . |
| 3940285 | | 6/1991 | (DE) . |
| 3942925 | | 6/1991 | (DE) . |

* cited by examiner

*Primary Examiner*—Renee Luebke
(74) *Attorney, Agent, or Firm*—Rader, Fishman & Grauer PLLC

(57) ABSTRACT

A compact snap switch that can be assembled mechanically and is equipped as a microswitch. The switch includes a housing for the microswitch and consists of two asymmetrically divided halves whose cut site runs along the edge of one of the large side surfaces. Thus a comparatively large assembly window and a favorable assembly direction are obtained due to the few undercuts of the components. In addition, due to the minor modifications of the machine-instrumented components, the switch can be easily modified for the different application formats. A movable contact lever with a moving contact is mounted so as to pivot in a knife-edge bearing. The free end of the contact lever has a wedge profile which with one of its two sides is exposed to a switching roller reloaded by a switching spring. Switching roller and switching spring are seated in a switching member which is movable along a straight path and abutted by a restoring towards an idle position. Upon forcing the switching member to move against the restoring spring, the switching roller passes the apex point of the wedge profile and acts on the other side of the wedge profile. Thus, the switching lever makes a pivoting movement, whereby the moving contact comes to rest with a fixed contact. Upon release of the moving force, the switching member is urged back to its idle position by the restoring spring. Thus, the switching lever returns to its original position.

5 Claims, 3 Drawing Sheets

SNAP SWITCH

CROSS-REFERENCE TO RELATED APPLICATION

This application is a continuation-in-part of a U.S. application Ser. No. 08/750,108 of Mar. 11, 1997 for "Snap Switch", now abandoned.

TECHNICAL FIELD

This invention generally relates to electrical switches and more particularly relates to turning indicator switches for motor vehicles.

BACKGROUND OF THE INVENTION

Snap switches are usually provided with a moving, preferably pivoting, contact lever and a switching member which acts upon it by means of spring action. In this case, the switching member is usually moved by means of a plunger sliding in a straight direction.

In order to achieve a sudden switching action, the spring engages first above and then below the longitudinal axis of the pivoting contact lever, depending on the movement of the switching member. Thus, a sudden reversal of the torque acting on the contact lever is attained. A snap switch of this kind is described, for example, in DE-PS 29 28 214. A disadvantage of the snap switch described therein is that the contact force of the contact lever is reduced to zero shortly before the switching process, so that the switching contact is not securely in place just before the switching. That can lead to an increase in the switch resistance shortly before the switching and also increased wear due to arcing and the like.

Additional consideration has been given to increasing the contact force of the contact lever shortly before the switching process instead of trying to reduce it. Due to that, an increasing contact force of the contact on the contact lever is obtained with respect to the fixed contact. This lasts up to the time when the contact lever is switched under a sudden change of direction of the comparatively large contact force, and then sets with large force onto the opposing contact. The contact force decreases somewhat after the end of the plunger movement. A similar switch is described, for example, in DE-PS 39 40 285. This already known switch pertains to a make contact. However, it can also be designed as a break contact or as a changeover switch while retaining the stated advantages.

On the other hand, a disadvantage of the switch according to DE-PS 39 40 285 is that a switching member (16) and a contact lever (33) are located essentially in the same plane. For that reason, a housing must be chosen long enough that it can hold the two components arranged in succession. In addition, the straight movement of a plunger (46) in this switch must be converted into a pivot motion of the switching member (16).

Therefore, a change was made, and DE-PS 39 42 925 discloses the switching member in the housing on a straight path extending essentially perpendicularly to the longitudinal direction of the contact lever. A disadvantage of this known switch, however, is that its housing is integrated as a single piece into a support element, i.e., the housing of the switch and also the support element itself are cast as a single piece of plastic. When using several switches, the switch housing can be assembled only with the components of the switch in the direction of the support element, that is, perpendicular to the plane of the support element. But assembling parallel to the plane of movement of the contact lever is comparatively difficult and can only be practically implemented by manual means. This is because individual components of the switch must necessarily undercut each other in the plane of movement of the contact lever, so that in the direction of installation they can only be inserted into the switch one after the other. In addition, the installation surface bounded by the side walls of the switch is comparatively small, so that only a comparatively small installation window is available for assembling.

SUMMARY OF THE INVENTION

According to the present invention, a snap switch comprises a housing formed by a first and a second housing parts, between which parts first and second connector elements are fixed. The second housing part has chambers and wall recesses open toward the first housing part to install the connector elements and other components of the switch in an open direction of the chambers and recesses. A contact lever movable in a plane of motion between an idle and a working positions is mounted so as to pivot in the housing and connected to the first connector element. Contacted by the contact lever in one of its end positions is a fixed contact rigidly attached in the housing and connected to the second connector element A switching member bears a wedge profile defining an apex, and it is adapted to be guided along a first path extending essentially perpendicular to the contact lever. Thus, the switching member, as the apex passes past the contact lever, forces the contact lever to move from the idle position to the working position.

The switching member bears a switching slider. They both are made of plastic, and the switching slider is inserted into the switching member The switching slider comprises a head portion and a leg portion and is inserted into the switching member with its leg portion that has a square cross-section to prevent its rotation within the switching member. A restoring spring braced against the housing is located in a recess of the switching member and biases the switching member to its rest position.

The head portion of the switching slider is imparted the form of two support surfaces, which face the contact lever and collectively form the wedge profile meeting the contact lever. The support surfaces may be covered with an insulating material or a heat-dissipating material.

The leg portion of the switching slider is made hollow to accommodate a switching spring pressing the switching slider against the contact lever. The spring is braced against the switching member and is guided by a guiding pin.

One end of the switching member, which is located opposite from the restoring spring, projects in the form of an actuating lug out of the recess of the housing. The actuating lug is equipped with a chamfer inclined with respect to the first path of the switching member so that the switching member can be actuated both by an actuating element moving in parallel to the first path, as well as by an actuating element moving transverse to the first path.

DETAILED DESCRIPTION OF THE PREFERRED EMBODIMENTS

Figure 1:
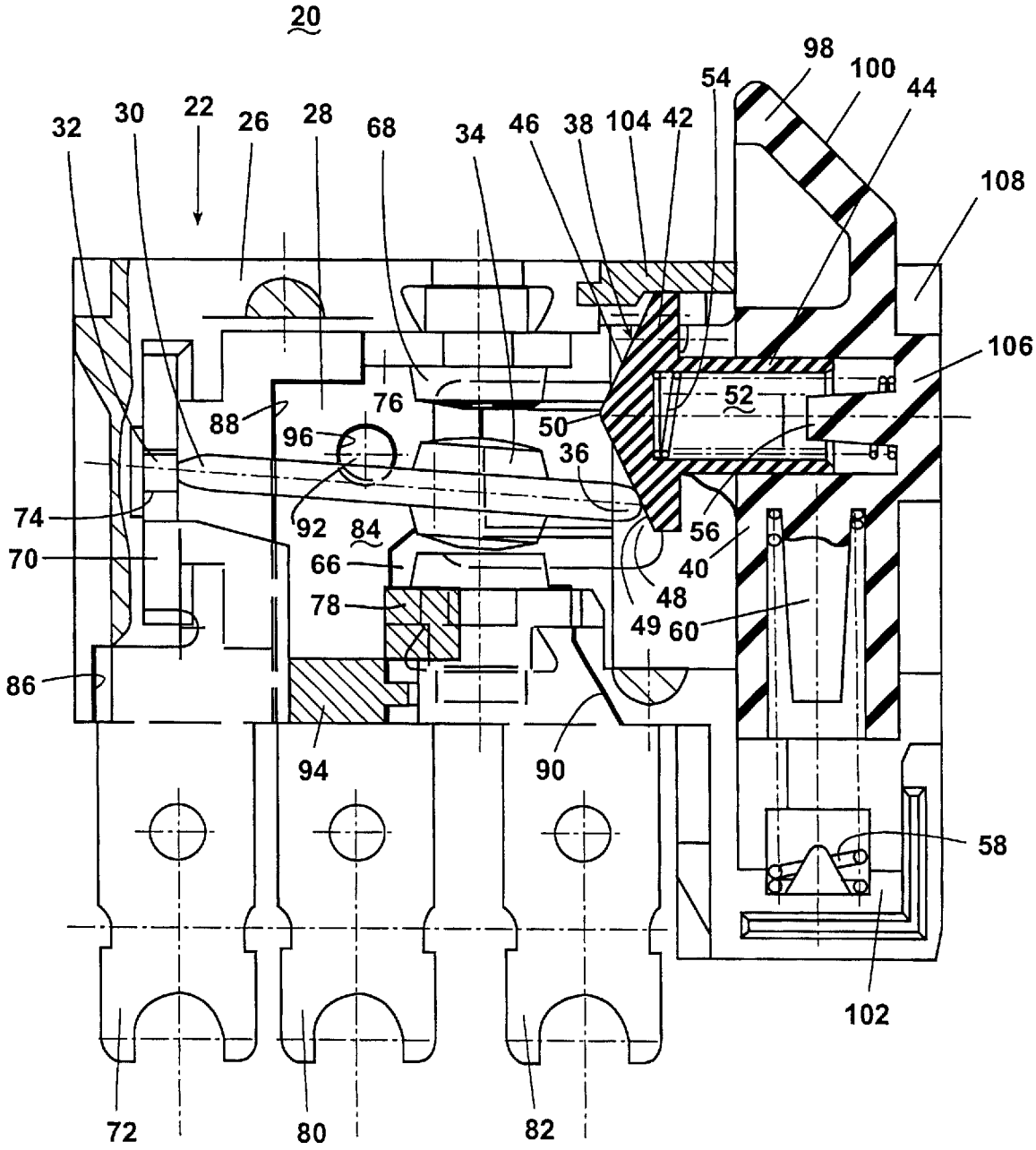
FIG. 1 is a partially cutaway representation of a snap switch of the present invention.
Figure 2:
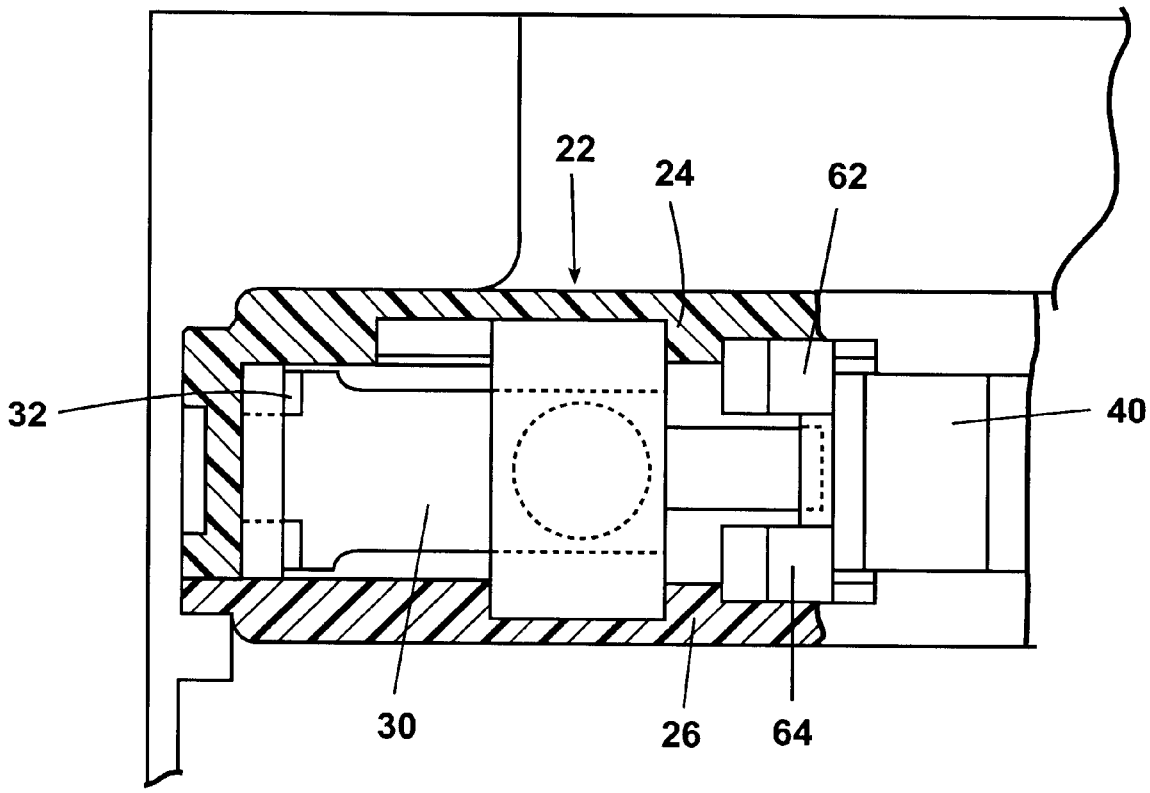
FIG. 2 is plan view of the switch according to FIG. 1 in which the housing is partly cut away.
Figure 3:
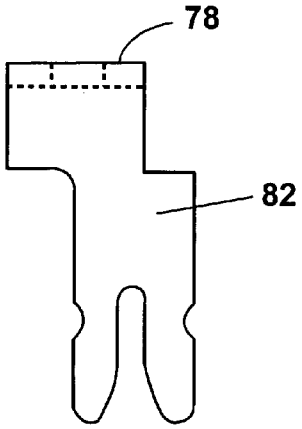
FIGS. 3–5 depict one of contact elements in top view, side view and front view thereof.
Figure 4:
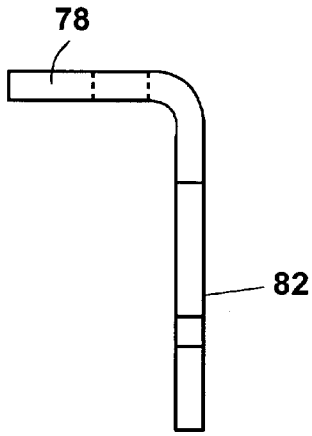
Figure 5:
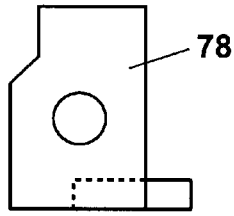
Figure 6:
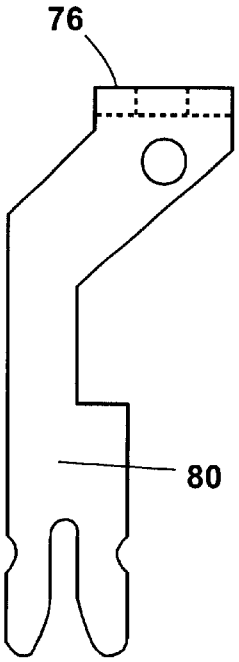
FIGS. 6–8 depict another of contact elements shown in the same views as the contact element of FIGS. 3–5.
Figure 7:
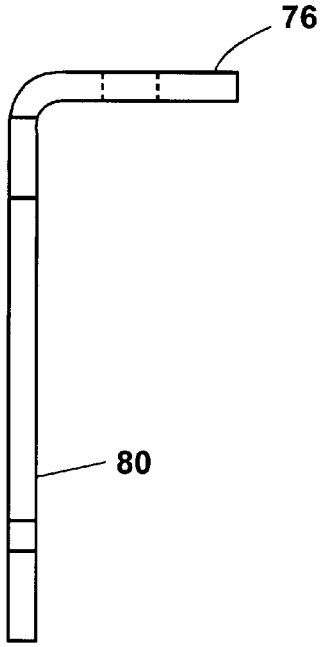
Figure 8:
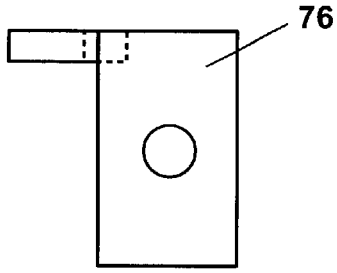

FIGS. 1 and 2 show a switch 20 with a housing 22 which consists of a first housing part 24 and a second housing part 26. The first housing part 24 holds in its interior space 28 the individual components belonging to the switch, whereas the second housing part 26 functions as a cover-like side wall of the housing 22 and can engage with the first housing part 24. The second housing part 26 at the same time covers the individual components, and prevents them from moving out of the interior space 28 of the first housing part 24 or from moving otherwise in any direction which is not expedient for the functioning of these components.

In the switch of the present invention, a moving contact lever 30 is provided that is mounted so as to pivot in a known manner in a knife-edge bearing 32 and bears a moving contact 34. A second end 36 of the contact lever 30 is free and made rounded. The end 36 of the contact lever 30 operatively cooperates with a switching slider 38 that is made of plastic and inserted in a switching member 40. The switching slider 38 comprises a head portion 42 and a leg portion 44. The head portion 42 has two support surfaces 46 and 48 by which the contact lever 30 is actuated. The support surfaces 46 and 48 are inclined with respect to each other and meet at an apex line 50 to form a wedge-like configuration.

In the case of a contact sparking and a temperature rising of the contact lever 30, it is the head portion 42 of the plastic switching slider 38 that will receive the heat. However, since the moving contact lever 30 touches the wedge-like surface of the head portion 42 via a contact line only, a little amount of the heat is expected to be transferred thereto that effectively prevents the slider 38 from being heat-damaged or at least heat-deformed. Additionally, the head portion 42, and especially the support surfaces 46 and 48 thereof, can be covered by the material 49 that either has insulating characteristics or is able to quickly dissipate the heat to other areas that are less sensitive to heat.

The leg portion 44 of the switching slider 38 has a square cross-section to prevent it from rotation in the interior of the switching member 40. The leg portion 44 is provided with a hollow 52 to accommodate a spiral-shaped switching spring 54 therein. The spring 54 is directed by a first guiding pin 56 that is a part of the switching member 40 and protrudes partially in the interior of the hollow 52 from a back side of the leg portion 44 of the switching slider 38. The switching member 40, accommodating the switching slider 38 with its associated switching spring 54, is adapted to be laterally movable. In its idle position, the switching member 40 is held by a spiral-shaped restoring spring 58. In its turn, the restoring spring 58 is directed by a second guiding pin 60 that is also a part of the switching member 40.

There are two pins (not shown) projecting laterally from either head portion 42 or leg portion 44 of the switching slide 38 on two opposing sides thereof. The pins are guided in two mutually parallel and opposing guiding grooves (not shown) so that the slider 38 is able to move horizontally under the action of the spring 54. The grooves are formed in guide lugs 62, 64 of the switching member 40.

In the position shown in FIG. 1, the support surface 48 of the head portion 42 is acting on the contact lever 30 and exerts a torque acting clockwise on the contact lever 30 so that its moving contact 34 acts on a first fixed-position contact 66. This state represents the idle state of the switch and the first contact 66 thus forms a break contact for the switch for example.

If the switching member 40 is directed against the force of the spring 58, it comes in its longitudinal direction along a straight path downward to the position where the apex line 50 of the wedge-profile head portion 42 meets the free end 36 of the contact lever 30. At this position, the effective force of the spring 54 is at its greatest. Accordingly further, the support surface 46 comes in touch with the contact lever 30 and starts acting on its free end 36. The surface 46 pivots the contact lever 30 upward until the moving contact 34 with its upper half in FIG. 1 comes to rest with a second fixed-position contact 68. In this manner, the second contact 68 acts as a make contact, for example. The contact lever 30 remains in this position as long as the switching member 40 remains in the held-down position just described.

A knife-edge bearing 32 braces the moving contact lever 30 against a first connector element 70. The element 70 has a terminal lug 72 that forms an electrical connection for the moving contact 34. As indicated in FIG. 2, contact lever 30 and knife-edge bearing 32 are braced in an opening 74 of the first connector element 70 against lateral displacement.

Accordingly, the fixed contacts 66 and 68 are mounted to second and third connector elements 76, 78 having terminal lugs 80, 82, respectively. Details of the second and third connector elements 76 and 78 are indicated in FIGS. 3 to 8. As can be seen in FIGS. 1, 6 to 8, if viewed at collectively, the second connector element 76 extends along the side wall 84 of the first housing part 24 and is bent to hold the second fixed contact 68. The second connector element 76 is located behind the moving contact lever 30 with no contact therebetween.

Conversely, as evident from FIGS. 1, and 3 to 5, the third connector element 78 is located in the region along the inside surface of the second housing part 26 and bent perpendicularly away therefrom to a holder of the first fixed contact 66.

As indicated in particular in FIG. 1, there are recesses 86 and 88 to hold the first and second connector elements 70 and 76, respectively, in the first housing part 24, and a recess 90 to hold the third connector element 78 in the second housing part 26. The recesses are located where the connector elements 70, 76, and 78 run along the inner walls of their respective housing parts 24 and 26. The interior space 28 and recesses 86, 88, and 90 are regularly open to the observer, so that the connector elements 70, 76, and 78 can be inserted perpendicularly to the plane of the drawing in FIG. 1 into the provided interior space and recesses. Thus, the structure allows for a more compact design.

Additionally, the permanence of the position of the connector element 76 is improved by a securing pin 92 and a boss 94. The pin 92 is cast onto the first housing part 24 and extends through a corresponding hole 96 in the connector element 76. The boss 94 is cast onto the second housing part 26 and presses the connector element 76 against the first housing part 24.

Since the switching member 40 does not need to carry electrical currents, it can be made entirely of plastic, so that a complex shaping can be more easily attained.

The force effect of the switching spring 54 of the switching member 40 is applied by means of the switching slider 38 that can be displaced essentially in the longitudinal direction of the contact lever 30. Therefore, friction forces that are generated when moving the wedge profile of the switching slider 38 past the free end 36 of the contact lever 30 are substantially reduced. At the same time, the guide lugs 62, 64 are used to center the wedge-profiled switching slider 38 against the contact lever 30. Since the switching member 40 itself is relatively short in the longitudinal direction of the contact lever 30, it is the guide lugs 62, 64 that project substantially in that direction and thus are able to absorb lateral forces of the contact lever 30.

Due to lateral forces acting on the switching member 40, it must be prevented from dropping out of the housing and moreover, it must be ensured that the switching member 40 can cover only a path suitable for the switching process. In the present invention, stops provided on the switching member 40 are used. In the selection of these stops, it is recommended that the guide lugs 62, 64, which are needed for the above-described purpose, be used simultaneously as stops.

If it is desired to use the switch of the present invention as a make contact and/or break contact, care must be taken that the switching member 40 holds a particular position (working position) only as long as a force is exerted on the switching member 40 itself. It is also possible to design the switch of the present invention as a changeover switch, in which case the restoring spring 58 can be omitted. In this case, however, care must be taken that two stops are provided for the switching member 40 that limit the movement of the switching member 40 upward and downward in its longitudinal direction. The force needed to hold the switching member 40 in one of the two changeover switch settings will then be applied exclusively by the switching spring 54 used in the switching member 40 itself for changeover switching. Therefore, this switching spring 54 must be sized accordingly. In addition, the switching member 40 must be driven in two directions from the outside.

There is an actuating lug 98 formed at an end of the switching member 40, preferably at the end turned away from the restoring spring 58. In a preferred embodiment, the actuating lug 98 is formed with a receiving chamfer 100 that is inclined, preferably at 45° with respect to the actuating plane of the switching member 40. This feature permits the switching member 40 to be actuated by forces running along the longitudinal direction of the switching member 40, as well as by those running transverse thereto.

The restoring spring 58 is preferably braced against a bottom portion 102 of the first housing part 24, and holds the switching member 40 in its rest position. In this position, the head portion 42 of the switching slider 38 rests against a top portion 104 of the second housing part 26. This feature is particularly recommended, since otherwise a separate rocker arm would have to be provided to move back the switching member 40 pressed in by the contact lever 30.

The switching member 40 can be provided with an actuating protrusion 106, which extends into a recess 108 of the housing 22. In this manner, forces to drive the switching member 40 can be applied from two directions.

One particularly favorable arrangement of the actuating protrusion 106 within the housing is obtained by means of sidewalls of the recess 108. In this case, the actuating protrusion 106, which does not project past the contour of the housing, remains of no effect for changeover purposes of the switch and does not interfere when several switches are located adjoining each other in the region of the recess 108. Then the actuation of the switch can take place directly by means of the actuating lugs 98.

For a simplified assembly, it is favorable according to the invention for the switching components to be inserted from a common direction at least in part simultaneously into the switch housing. According to the present invention, the first housing part 24 forms essentially the entire enclosed housing part that is open only on a single side, in which the individual components can be inserted through the open side. In this case, the individual switching parts have been designed so that they can be manually inserted predominately at one given time, one after the other, and in addition they can be inserted mechanically into the first housing part 24 while observing a specified sequence, by means of a movement essentially in the same direction.

In addition, a locked attachment of the second housing part 26 to the first housing part 24 contributes to their positional definition after assembly of the components. In this regard, the second housing part 26 features protrusions (not visible in the figure) which extend downward, for example, through the area bounding the first housing part 24 perpendicular to the viewer's plane and are braced, for example, against the second connector element 76. Thus, a movement of this connector element from the plane of FIG. 1 toward the viewer, will be prevented The switch of the present invention is ideally suited to be inserted into a switch system which can take over the different kinds of switching tasks. Furthermore, the different switch variants can be used in combination. One important application of the switch of the present invention is for control task in motor vehicles.

The switch according to this invention is well suited for the transfer of high power. The heat produced can be advantageously dissipated through openings installed in the housing 22. A particularly large opening can be installed centrally in the second housing part 26, and one can mount the switch, for example, with the second housing part 26 facing upward so that the second housing part is located with the ventilation opening above the first housing part to allow the heat to readily escape upward.

While preferred embodiments of the present invention have been disclosed hereinabove, it is to be understood that these embodiments are given by example only and not in a limiting sense. Those skilled in the art may make various modifications and additions to the preferred embodiments chosen to illustrate the invention without departing from the spirit and scope of the present contribution to the art. Accordingly, it is to be realized that the patent protection sought and to be afforded hereby shall be deemed to extend to the subject matter claimed and all equivalence thereof fairly within the scope of the invention.

What is claimed is:

1. A snap switch comprising: a housing formed by a first housing part and a second housing part; a contact lever movable in a plane of motion between an idle end position and a working end position, said contact lever being mounted so as to pivot in said housing, and connected to a first connector element; at least one fixed contact rigidly fixed in said housing, contacted by said contact lever in one of said idle end position and working end position thereof, and connected to a second connector element; and a switching member in said housing; wherein said switching member bears a switching slider of a wedge profile defining an apex, said switching slider comprising a head portion and a leg portion and being inserted in sad switching member with said leg portion thereof, said leg portion having a square crosssection to prevent its rotation within said switching member, and wherein said switching member is adapted to be guided along a first path extending essentially perpendicular to said contact lever, whereby said switching member forces said contact lever to move from said idle position to said working position, as said apex moves past said contact lever.

2. The switch according to claim 1, wherein said leg portion is made hollow to accommodate a switching spring pressing said switching slider against said contact lever.

3. The switch according to claim 2, wherein said switching spring is braced against said switching member and is guided by a guiding pin thereof.

4. A snap switch comprising:

a housing formed by a first and a second housing parts;

a contact lever movable in a plane of motion between an idle and a working positions, and mounted so as to pivot in said housing, and connected to a first connector element;

at least one fixed contact rigidly attached in said housing, contacted by said contact lever in one of said end positions thereof, and connected to a second connector element; and a switching member in said housing;

wherein said switching member bears a wedge profile defining an apex, is adapted to be guided along a first path extending essentially perpendicular to said contact lever, and bears a switching slider, said switching slider comprising a head portion and a leg portion, said head portion comprising two support surfaces facing said contact lever, said support surfaces being covered with an insulating material and collectively forming said wedge profile meeting said contact lever, whereby said switching member, as said apex passes past said contact lever, forces said contact lever to move from said idle position to said working position.

5. A snap switch comprising:

a housing formed by a first and a second housing parts;

a contact lever movable in a plane of motion between an idle and a working positions, and mounted so as to pivot in said housing, and connected to a first connector element;

at least one fixed contact rigidly attached in said housing, contacted by said contact lever in one of said end positions thereof, and connected to a second connector element; and a switching member in said housing;

wherein said switching member bears a wedge profile defining an apex, is adapted to be guided along a first path extending essentially perpendicular to said contact lever, and bears a switching slider, said switching slider comprising a head portion and a leg portion, said head portion comprising two support surfaces facing said contact lever, said support surfaces being covered with a heat-dissipating material and collectively forming said wedge profile meeting said contact lever, whereby said switching member, as said apex passes past said contact lever, forces said contact lever to move from said idle position to said working position.

* * * * *